US009521878B2

(12) United States Patent
Park et al.

(10) Patent No.: US 9,521,878 B2
(45) Date of Patent: Dec. 20, 2016

(54) FUNCTIONAL SHOE FOR AUTOMATICALLY PREVENTING SLIP

(71) Applicants: Young Keun Park, Gyeonggi-do (KR); Young Hwa Park, Gyeonggi-do (KR)

(72) Inventors: Young Keun Park, Gyeonggi-do (KR); Young Hwa Park, Gyeonggi-do (KR)

( * ) Notice: Subject to any disclaimer, the term of this patent is extended or adjusted under 35 U.S.C. 154(b) by 0 days.

(21) Appl. No.: 14/400,380

(22) PCT Filed: May 10, 2013

(86) PCT No.: PCT/KR2013/004127

§ 371 (c)(1),
(2) Date: Nov. 11, 2014

(87) PCT Pub. No.: WO2013/169052

PCT Pub. Date: Nov. 14, 2013

(65) Prior Publication Data

US 2015/0128456 A1 May 14, 2015

(30) Foreign Application Priority Data

May 11, 2012 (KR) ..... 10-2012-0050454

(51) Int. Cl.
*A43C 15/02* (2006.01)
*A43C 15/12* (2006.01)
(Continued)

(52) U.S. Cl.
CPC ..... *A43C 15/02* (2013.01); *A43C 15/063* (2013.01); *A43C 15/066* (2013.01); *A43C 15/12* (2013.01); *A43C 15/14* (2013.01)

(58) Field of Classification Search
CPC ..... A43C 15/02; A43C 15/16; A43C 15/063; A43C 15/066; A43C 15/12; A43C 15/08; A43C 15/09; A43C 15/164
(Continued)

(56) References Cited

U.S. PATENT DOCUMENTS 2,484,389 A * 10/1949 Schatz ..... A43C 15/09 182/201
3,337,972 A * 8/1967 Stollman ..... A43C 15/09 36/1
(Continued)

FOREIGN PATENT DOCUMENTS

KR 20-1986-0003624 12/1986
KR 20-0238233 10/2001
(Continued)

OTHER PUBLICATIONS

International Search Report for corresponding International Patent Application No. PCT/KR2013/0042127 (mailed Sep. 2, 2013).
European Search Report for corresponding European Patent Application No. 13786988.9 (mailed Jul. 6, 2015).
(Continued)

*Primary Examiner* — Shaun R Hurley
*Assistant Examiner* — Bao-Thieu L Nguyen
(74) *Attorney, Agent, or Firm* — Merchant & Gould P.C.

(57) ABSTRACT

Provided is a functional shoe that automatically prevents a slip, the function shoe including a rotation body part fixed to an outsole of the functional shoe to rotate to a front or rear side of the functional shoe, and an anti-slip part connected to the rotation body part to contact a ground and rotating integrally with the rotation body part according to a sliding direction of the functional shoe. The anti-slip part includes a first distal end, which is sharp and is oriented to the front side of the functional shoe, and a second distal end which is sharp and is oriented to the rear side of the functional shoe.

10 Claims, 10 Drawing Sheets

(51) Int. Cl.
*A43C 15/06* (2006.01)
*A43C 15/14* (2006.01)

(58) Field of Classification Search
USPC ..... 36/59 R, 7.6, 134, 67 R, 67 A
See application file for complete search history.

(56) References Cited

U.S. PATENT DOCUMENTS 3,631,614 A 1/1972 Rice
3,717,238 A * 2/1973 Fox ..... A43B 5/0415 36/61
4,333,249 A * 6/1982 Schaefer ..... A43B 5/1633 280/11.19
4,523,396 A * 6/1985 Dassler ..... A43B 13/26 36/134
5,299,369 A * 4/1994 Goldman ..... A43C 15/14 36/127
5,377,431 A * 1/1995 Walker ..... A43C 15/168 36/134
5,497,565 A * 3/1996 Balgin ..... A43C 15/14 36/134
6,079,127 A * 6/2000 Nishimura ..... A43C 15/14 36/134
6,112,436 A * 9/2000 Quellais ..... A43C 15/09 36/124
6,385,865 B1 * 5/2002 Jang ..... A43B 5/002 36/124
6,675,504 B1 1/2004 Biancucci et al.
7,194,826 B2 * 3/2007 Ungari ..... A43B 5/02 36/128
7,788,828 B2 * 9/2010 Krouse ..... A43B 3/0005 36/134
8,127,470 B2 * 3/2012 Connor ..... A43C 15/02 36/134
8,191,286 B2 * 6/2012 Krikorian ..... A43B 13/26 36/134
8,215,034 B2 * 7/2012 Krouse ..... A43B 3/0005 36/134
8,453,349 B2 * 6/2013 Auger ..... A43C 15/162 36/59 R
8,720,086 B2 * 5/2014 Auger ..... A43C 15/162 36/134
9,101,180 B2 * 8/2015 Baker ..... A43B 3/0042
2005/0172518 A1 * 8/2005 Ungari ..... A43B 5/02 36/134
2005/0229434 A1 * 10/2005 Yoo ..... A43C 15/063 36/59 R
2006/0174518 A1 * 8/2006 Fogarty ..... A43B 13/223 36/61
2007/0251128 A1 * 11/2007 Yen ..... A43C 15/161 36/134
2007/0261271 A1 * 11/2007 Krouse ..... A43B 3/0005 36/61
2008/0092409 A1 * 4/2008 Koo ..... A43C 15/161 36/59 R
2009/0151199 A1 * 6/2009 Connor ..... A43C 15/02 36/61
2009/0193681 A1 * 8/2009 Fanetti ..... A43C 15/14 36/61
2009/0235558 A1 * 9/2009 Auger ..... A43C 15/162 36/30 R
2010/0293818 A1 11/2010 Lefgren
2011/0005103 A1 * 1/2011 Krouse ..... A43B 3/0005 36/134
2011/0126426 A1 * 6/2011 Mark ..... A43C 15/168 36/61
2013/0139745 A1 * 6/2013 Machida ..... B63H 16/02 114/363
2014/0310995 A1 * 10/2014 Campari ..... A43C 15/161 36/134
2015/0013194 A1 * 1/2015 Hofmann ..... A43C 15/162 36/127

FOREIGN PATENT DOCUMENTS

KR 10-2003-0062655 A 7/2003
RU 2218851 C2 12/2003
RU 2313267 C1 12/2007
RU 2401624 C1 10/2010
WO WO 2010/101492 A1 9/2010

OTHER PUBLICATIONS

Russian Decision on Grant for Russian Patent Application No. 2014150032 (mailed Feb. 2, 2016).

* cited by examiner

FUNCTIONAL SHOE FOR AUTOMATICALLY PREVENTING SLIP

CROSS-REFERENCE TO RELATED APPLICATIONS

This application is a U.S. National Stage Application under 35 U.S.C. §371 of International Patent Application No. PCT/KR 2013/004127 filed 10 May 2013, which claims the benefit of priority to Korean Patent Application No. 10-2012-0050454 filed 11 May 2012, the disclosures of all of which are hereby incorporated by reference in their entireties. The International Application was published in Korean on 14 Nov. 2013 as WO 2013/169052.

FIELD OF THE INVENTION

The present invention relates to a functional shoe for automatically preventing a slip, and more particularly, to a functional shoe that automatically operates according to a slip of the functional shoe so as to prevent the slip although a person wearing the functional shoe does not perform a separate process.

DISCUSSION OF RELATED ART

Mountain hikers further wear crampons under hiking boots to prevent a slip of the hiking boots, specifically, in winter. However, the wearing of crampons under hiking boots may be inconvenient. In addition, the crampons may irritate the wearer. To address these issues, a hiking boot including crampons therein is disclosed. However, even in this case, a wearer should perform a separate process (for example, a process of unscrewing the crampons from the hiking boot) in order to use the crampons, which still gives inconvenience to the wearer.

SUMMARY OF THE INVENTION

Technical Problem

Accordingly, the present invention aims at providing a functional shoe that automatically operates according to a slip of the functional shoe so as to prevent the slip although a person wearing the functional shoe does not perform a separate process.

Technical Solution

According to an aspect of the present invention, there is provided a functional shoe that automatically prevents a slip, the function shoe including: a rotation body part fixed to an outsole of the functional shoe to rotate to a front or rear side of the functional shoe; and an anti-slip part connected to the rotation body part to contact a ground and rotating integrally with the rotation body part according to a sliding direction of the functional shoe, wherein the anti-slip part includes a first distal end, which is sharp and is oriented to the front side of the functional shoe, and a second distal end which is sharp and is oriented to the rear side of the functional shoe.

Advantageous Effects

A functional shoe according to the present invention includes an anti-slip part that selectively rotates to the front or rear side of the functional shoe through a rotation body part according to a direction in which the functional shoe slides. Thus, although a person wearing the functional shoe does not perform a separate process, the anti-slip part automatically operates according to a slip of the functional shoe so as to prevent the slip.

DETAILED DESCRIPTION

Hereinafter, preferred embodiments of the present invention will be described in detail with reference to the accompanying drawings. However, the present invention is not limited to the following embodiments.

Figure 1:
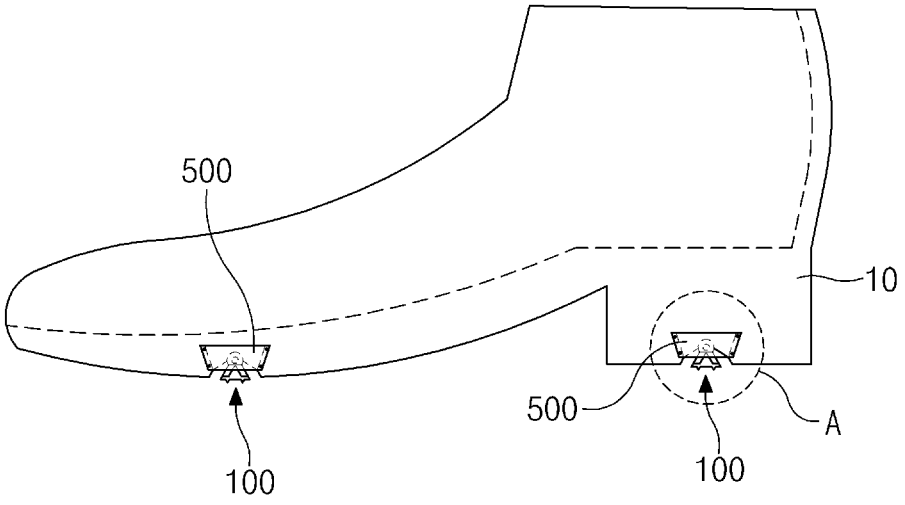
FIG. 1 is a side view illustrating a functional shoe according to an embodiment of the present invention.
Figure 2:
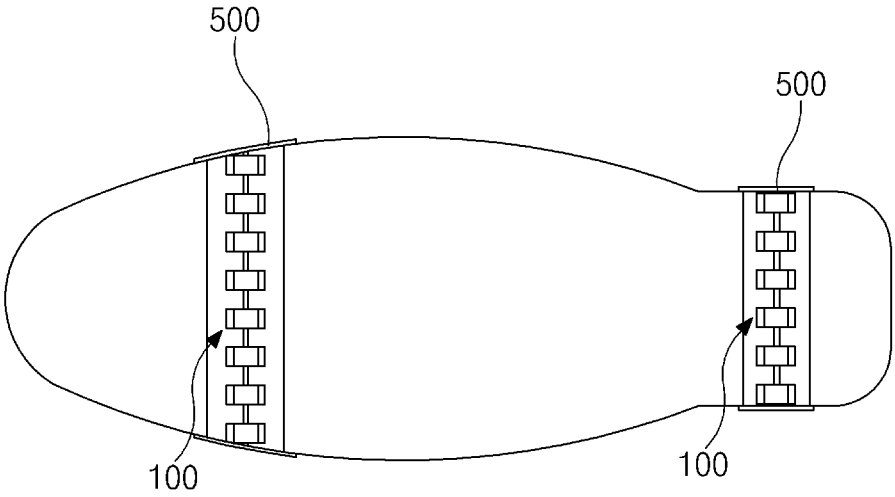
FIG. 2 is a bottom view illustrating the functional shoe of FIG. 1.

FIG. 1 is a side view illustrating a functional shoe according to an embodiment of the present invention. FIG. 2 is a bottom view illustrating the functional shoe of FIG. 1. Referring to FIGS. 1 and 2, the functional shoe includes an outsole 10 and crampon parts 100 disposed on the outsole 10. The crampon parts 100 prevent a slip of the functional shoe, which will be described later in more detail. The locations of the crampon parts 100 may be variously changed if necessary. That is, as illustrated in FIGS. 1 and 2, the crampon parts 100 may be disposed on the front part and the rear part (the heel) of the functional shoe, respectively, or be disposed on only the rear part thereof. The outsole 10 includes the heel.

Figure 3:
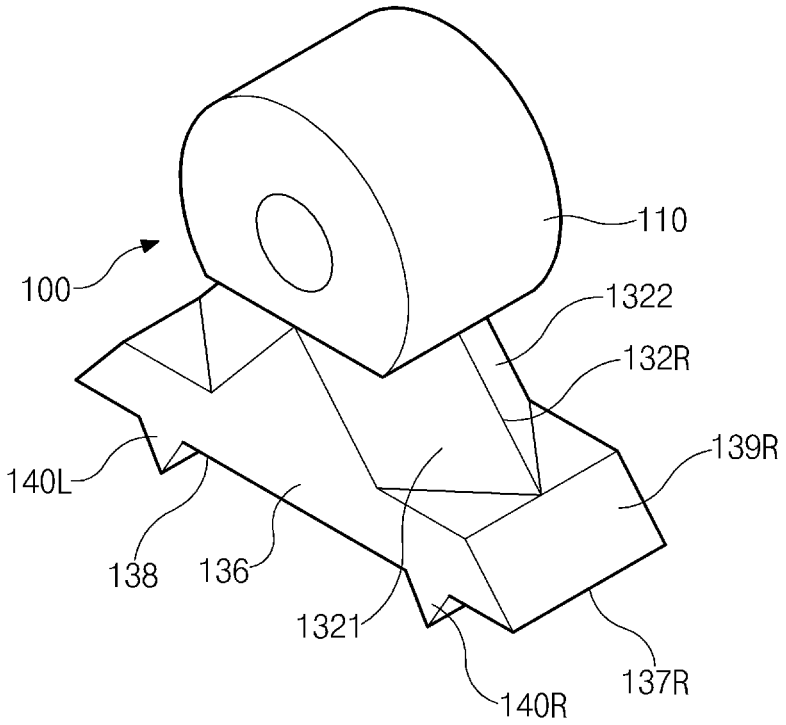
FIG. 3 is a perspective view illustrating a crampon part applied to the functional shoe of FIG. 1.
Figure 4:
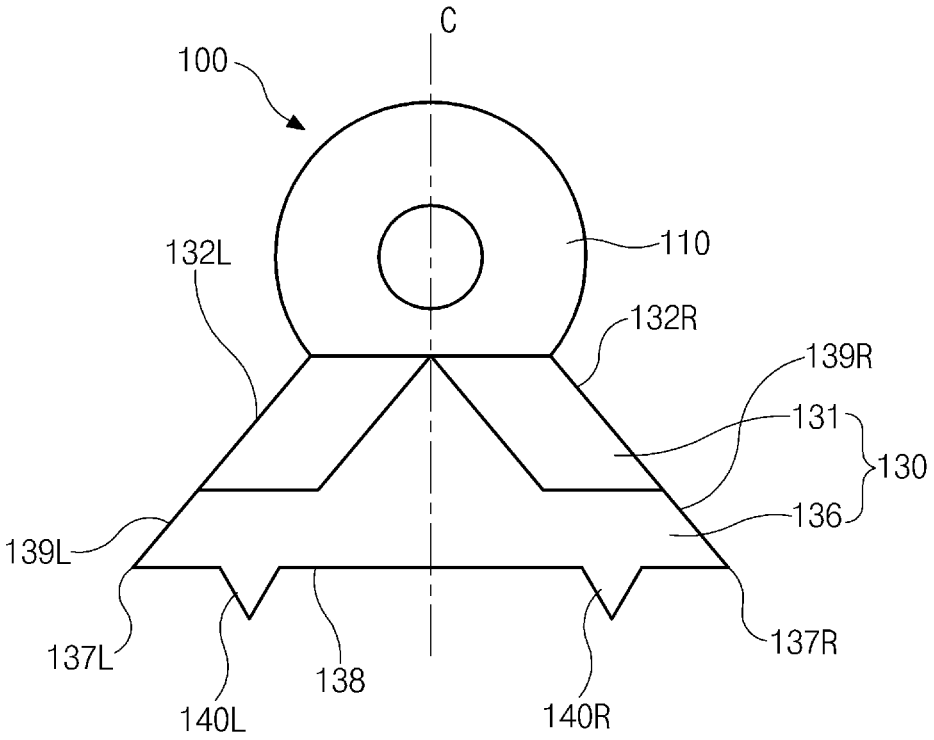
FIG. 4 is a front view illustrating the crampon part of FIG. 3.

Referring to FIGS. 3 and 4, the crampon parts 100, which automatically prevents a slip of the functional shoe, includes a rotation body part 110 and an anti-slip part 130. FIG. 3 is a perspective view illustrating a crampon part applied to the functional shoe of FIG. 1. FIG. 4 is a front view illustrating the crampon part of FIG. 3; The rotation body part 110 of the crampon parts 100 is fixed to the outsole 10 (or an installation part to be described later when the installation part is provided) to rotate to the front or rear side of the functional shoe.

That is, while the rotation body part 110 rotates, the rotation body part 110 is supported by the outsole 10. The support may be achieved by forming a recess in the outsole 10 (or an installation part to be described later when the installation part is provided) in a width direction of the functional shoe and inserting the rotation body part 110 in the recess. Alternatively, the support may be achieved by installing a predetermined shaft on the outsole 10 in the width direction of the functional shoe and installing the rotation body part 110 on the shaft (also in this case, a recess for the rotation body part 110 is formed in the outsole 10). "The front side of the functional shoe" means the left side of FIG. 1, and "the rear side of the functional shoe" means the right side of FIG. 1. In addition, the width direction of the functional shoe means a direction toward the paper surface of FIG. 1.

The anti-slip part 130 is connected to the rotation body part 110 to rotate integrally with the rotation body part 110 according to a slip of the functional shoe on a ground, thereby preventing the slip. The anti-slip part 130 includes an upper body 131 connected to the rotation body part 110, and a lower body 136 connected to the upper body 131 and contacting a ground G.

The lower body 136 includes a first distal end 137L, which is sharp and is oriented to the front side of the functional shoe, and a second distal end 137R which is sharp and is oriented to the rear side of the functional shoe. An operation of the anti-slip part 130 will be described later in more detail. The upper and lower bodies 131 and 136 may be integrally formed. The rotation body part 110 and the anti-slip part 130 may be integrally formed. When the upper and lower bodies 131 and 136 may be integrally formed, the upper and lower bodies 131 and 136 may be formed as a single piece in the anti-slip part 130. When the rotation body part 110 and the anti-slip part 130 may be integrally formed, the rotation body part 110 and the anti-slip part 130 may be formed as a single piece.

Figure 5:
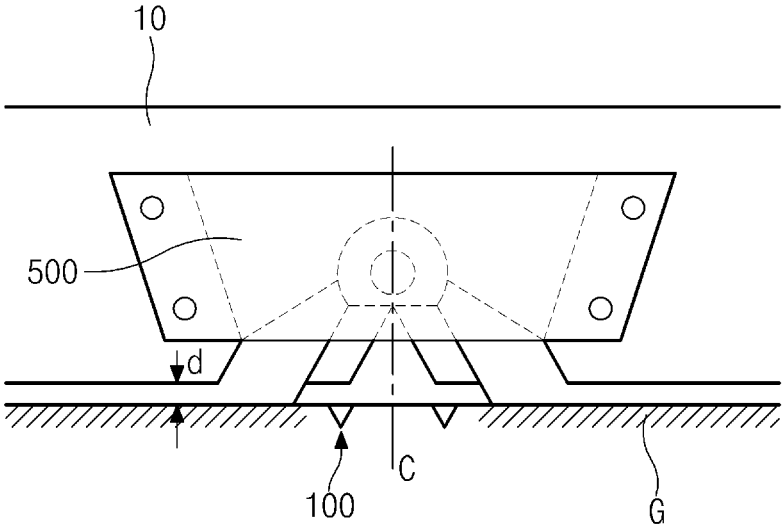
FIG. 5 is an enlarged side view illustrating a portion A of FIG. 1.
Figure 6:
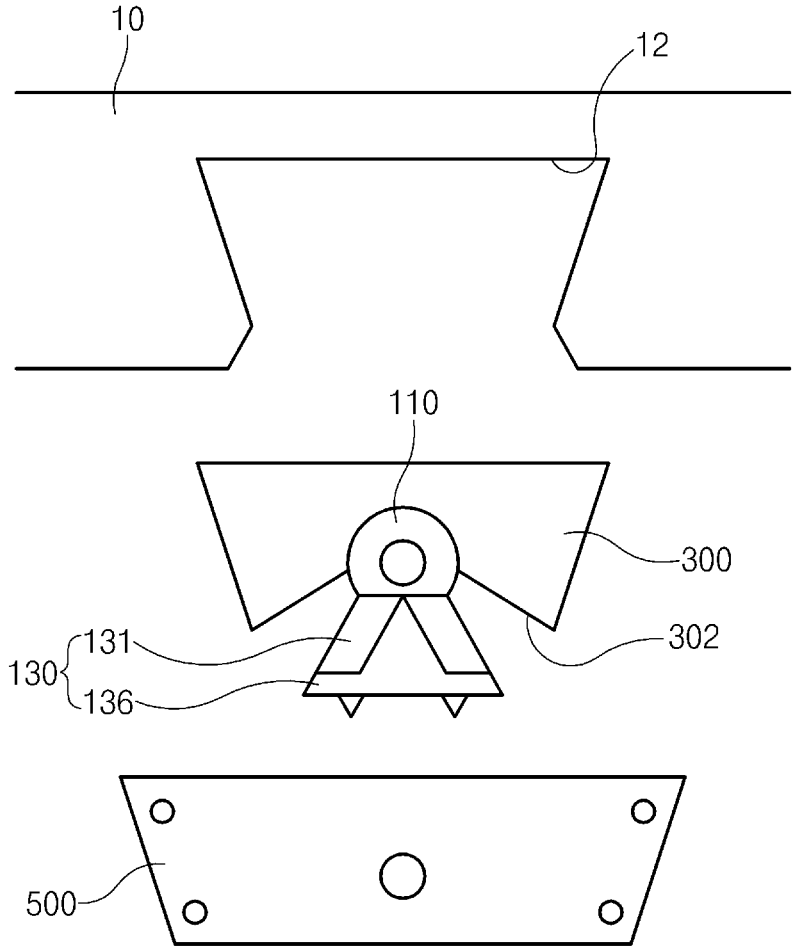
FIG. 6 is a side view illustrating a cover part and an installation part of FIG. 5, separated from an outsole of the functional shoe.
Figure 7:
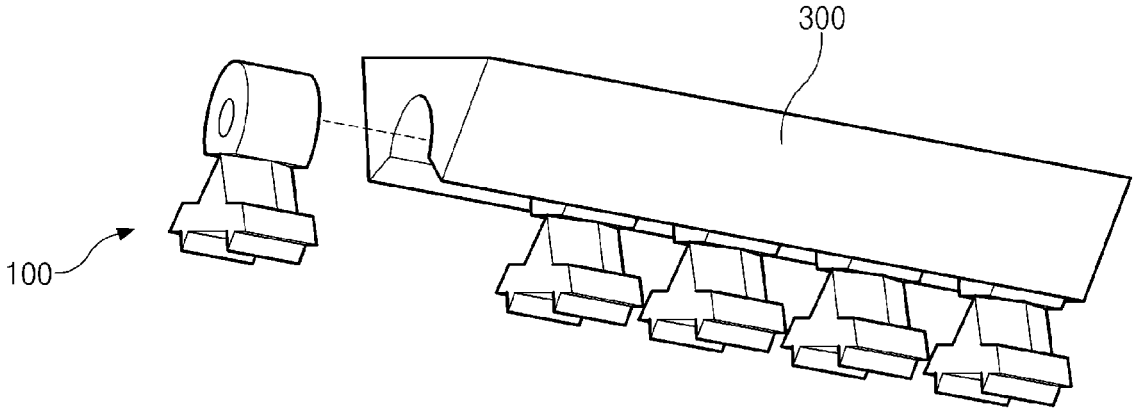
FIGS. 7 and 8 are perspective views illustrating the installation part of FIG. 5.
Figure 8:
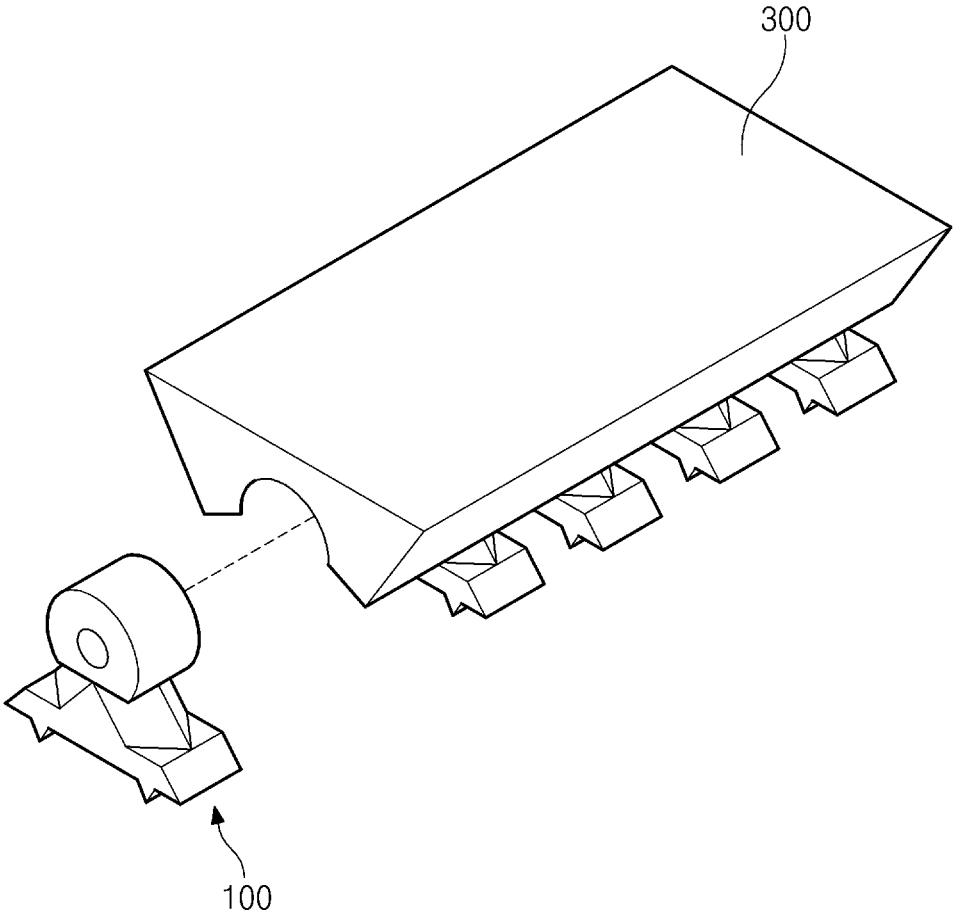

Although the crampon parts 100 may be provided directly on the outsole 10 as described above, the crampon parts 100 may be provided indirectly on the outsole 10 through an installation part 300 as illustrated in FIGS. 5 to 8. FIG. 5 is an enlarged side view illustrating a portion A of FIG. 1. FIG. 6 is a side view illustrating a cover part and an installation part of FIG. 5, separated from an outsole of the functional shoe. FIGS. 7 and 8 are perspective views illustrating the installation part of FIG. 5.

Referring to FIGS. 5 and 6, an insertion recess 12 is formed in the outsole 10 in the width direction of the functional shoe in order to install the installation part 300 on the outsole 10. After that, the installation part 300 may be slid into the insertion recess 12. That is, the installation part 300 may be similar to a dove tail to be fitted in the insertion recess 12. Thus, when the crampon part 100 is worn, the functional shoe may be reused by replacing the crampon part 100 through the installation part 300.

That is, when the crampon part 100 is worn, the crampon part 100 and the installation part 300 may be removed from the outsole 10, and then, a new installation part 300 including a new crampon part 100 may be installed on the outsole 10. Alternatively, the crampon part 100 and the installation part 300 may be removed from the outsole 10, then, a new crampon part 100 may be installed on the installation part 300 as illustrated in FIGS. 7 and 8, and then, the installation part 300 including the new crampon part 100 may be installed on the outsole 10. As such, when the crampon parts 100 are provided on the outsole 10 through the installation part 300, the functional shoe can be more conveniently and economically maintained or repaired.

When only the installation part 300 is inserted in the insertion recess 12, the installation part 300 may be accidentally removed from the outsole 10. Thus, the functional shoe may further include a cover part 500 to prevent the removal of the installation part 300. That is, referring to FIGS. 5 and 6, the installation part 300 is installed on the outsole 10, and then, an outer surface of the installation part 300 is covered with the cover part 500 to prevent the installation part 300 from being accidentally removed from the outsole 10. The top cover 500 may be removably fixed to the outsole 10, considering the reason why the installation part 300 is provided.

The rotation body part 110 and the anti-slip part 130 may be separately formed, and then, the anti-slip part 130 may be removably attached to the rotation body part 110. In this case, when the anti-slip part 130 is worn, the anti-slip part 130 can be very efficiently replaced.

Referring to FIG. 8, the rotation body part 110 may be provided in plurality in the width direction of the functional shoe. Also, the anti-slip part 130 may be provided in plurality to correspond to the rotation body parts 110. In this case, even when an amount of slip is small, the rotation body parts 110 and the anti-slip parts 130 sensitively respond to the slip. Alternatively, a single rotation body part may be elongated in the width direction of the functional shoe. Also, a single anti-slip part may be elongated in the width direction of the functional shoe to correspond to the single rotation body part. In this case, the single anti-slip part and the single rotation body part more intensively prevent a slip.

Hereinafter, an operation of the crampon parts 100 will now be described in detail with reference to FIGS. 9 and 10.

Figure 9:
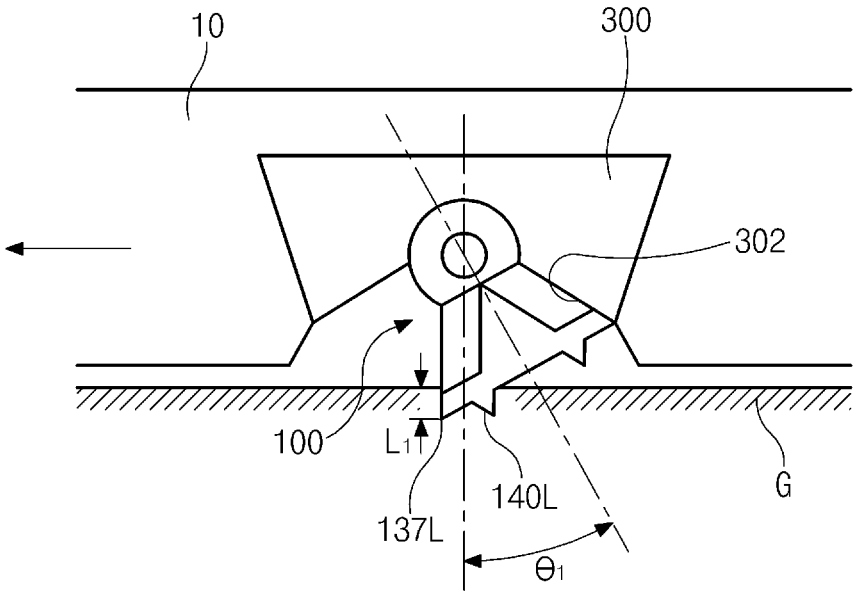
FIG. 9 is a side view illustrating an operation of a crampon part when the functional shoe slides on a ground to the left side of FIG. 9.

FIG. 9 is a side view illustrating an operation of a crampon part when the functional shoe slides on a ground to the left side of FIG. 9. FIG. 10 is a side view illustrating an operation of the crampon part when the functional shoe slides on the ground to the right side of FIG. 10. The top cover 500 is omitted in FIGS. 9 and 10 for convenience in description.

Referring to FIG. 9, when the functional shoe slides on the ground G to the left side of FIG. 9 (refer to an arrow), the anti-slip part 130 is rotated to the right side through the rotation body part 110 by a resistance applied to the lower body 136. In other words, when the functional shoe slides on the ground G to the left side, frictional force is applied to the lower body 136 to the right side. The frictional force rotates the anti-slip part 130 to the right side through the rotation body part 110. This case may occur during the descent of a mountain when the left side of FIG. 9 is the front side of the functional shoe. As a result, the rotation of the anti-slip part 130 is stopped by a slope 302 formed in the outsole 10 (in the installation part 300 of FIG. 9).

As such, when the crampon part 100 rotates to the right side (or the rear side of the functional shoe), the first distal end 137L that is sharp and is oriented to the front side of the functional shoe is directed to the ground G as illustrated in FIG. 9. When the first distal end 137L is directed to the ground G, the first distal end 137L is stuck in the ground G, thus preventing a slip of the functional shoe. In other words, when the crampon part 100 is rotated to the right side (or the rear side of the functional shoe) by $\theta_1$, the crampon part 100 is stuck in the ground G by $L_1$, thus preventing a slip of the functional shoe.

Figure 10:
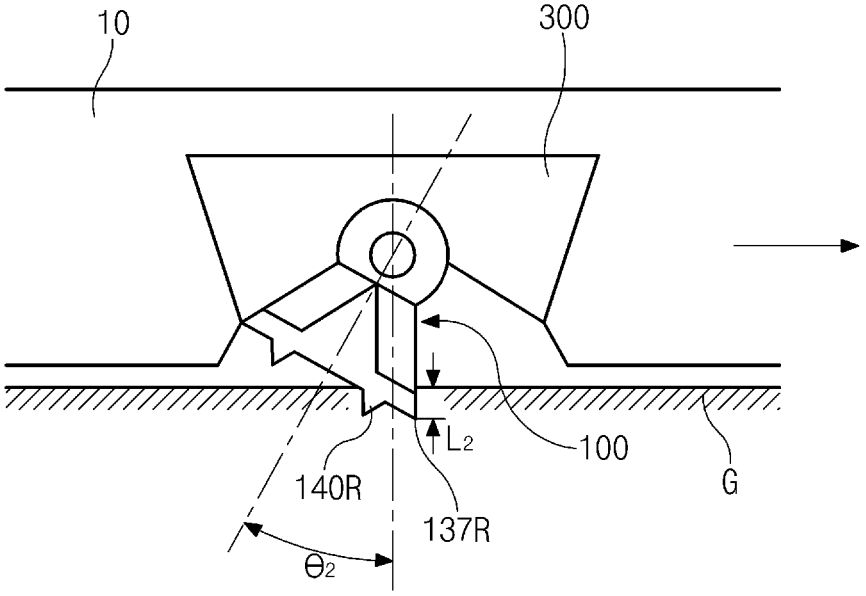
FIG. 10 is a side view illustrating an operation of the crampon part when the functional shoe slides on the ground to the right side of FIG. 10.

On the contrary, referring to FIG. 10, when the functional shoe slides on the ground G to the right side of FIG. 10 (refer to an arrow), the anti-slip part 130 is rotated to the left side through the rotation body part 110 by a resistance applied to the lower body 136. This case may occur during the ascent of a mountain when the left side of FIG. 10 is the front side of the functional shoe. As such, when the crampon part 100 rotates to the left side (or the front side of the functional shoe), the second distal end 137R that is sharp and is oriented to the rear side of the functional shoe is directed to the ground G as illustrated in FIG. 10. When the second distal end 137R is directed to the ground G, the second distal end 137R is stuck in the ground G, thus preventing a slip of the functional shoe. In other words, when the crampon part 100 is rotated to the left side (or the front side of the functional shoe) by $\theta_2$, the crampon part 100 is stuck in the ground G by $L_2$, thus preventing a slip of the functional shoe.

As such, the anti-slip part 130 selectively rotates to the front or rear side of the functional shoe through the rotation body part 110 according to a direction in which the functional shoe slides. According to the rotation of the anti-slip part 130, one of the first distal end 137L oriented to the front side of the functional shoe, and the second distal end 137R oriented to the rear side of the functional shoe is selectively stuck in the ground G. Thus, although a person wearing the functional shoe does not perform a separate process, the anti-slip part 130 automatically operates according to a slip of the functional shoe so as to prevent the slip. According to the operation of the anti-slip part 130, the functional shoe protects a person wearing the functional shoe from a slip under a slip condition (for example, the ascent or descent of a mountain, or walking on ice).

Each of the first and second distal ends 137L and 137R, which finally prevent a slip of the functional shoe, is oriented to the front or rear side of the functional shoe. This means that a sharp end of the first and second distal ends 137L and 137R is substantially oriented to the front or rear side of the functional shoe in a basic position as illustrated in FIG. 5 (a position before a rotation as illustrated in FIG. 5). For example, referring to FIGS. 3 to 5, a sharp distal end of the lower body 136 may be defined as an edge between a horizontal surface 138 and a slope 139. That is, the lower body 136 may include the horizontal surface 138 contacting the ground G, a first slope 139L extending in a right upper direction from a left distal end of the horizontal surface 138 when being viewed in the width direction of the functional shoe, and a second slope 139R extending in a left upper direction from a right distal end of the horizontal surface 138 when being viewed in the width direction of the functional shoe. Although the left and right distal ends that are sharp may be defined as edges, the left and right distal ends may have a predetermined thickness. In other words, the left and right distal ends may be blunter than shapes as illustrated in FIG. 5. A blade part to be described later may also be blunter than an illustrated shape.

When a resistance applied to the lower body 136 is small, the crampon part 100 may not be rotated. For example, when a wearer walks on ice, a sufficient resistance may not be applied to the lower body 136, and thus, the lower body 136 may fail to prevent a slip. To address this issue, referring to FIGS. 3 to 5, the lower body 136 may include two bottom protrusions 140L and 140R, which are sharp and extend to the ground G. Referring to FIGS. 4 and 5, the bottom protrusion 140L may be disposed at the left side of a vertical line C of FIG. 5, and the bottom protrusion 140R may be disposed at the right side of the vertical line C.

Accordingly, each of the bottom protrusions 140L and 140R may appropriately operate to correspond to a slip. That is, referring to FIG. 9, when the functional shoe slides to the left side, a great resistance is applied to the bottom protrusion 140L, so that the crampon part 100 can efficiently rotate to the right side. In addition, referring to FIG. 10, when the functional shoe slides to the right side, a great resistance is applied to the bottom protrusion 140R, so that the crampon part 100 can efficiently rotate to the left side. Thus, since the lower body 136 includes the bottom protrusions 140L and 140R, even when a resistance directly applied to the lower body 136 is insufficient, the crampon part 100 appropriately rotates in a desired direction. The vertical line C of FIG. 5 extends to the ground G from a rotation center of the rotation body part 110.

Such a bottom protrusion may be provided in plurality. In this case, a part of the bottom protrusions may be disposed at the left side of the vertical line C of FIG. 5, and the rest thereof may be disposed at the right side of the vertical line C.

A space is formed between the outsole 10 (or the installation part 300 when the installation part 300 is provided) and the anti-slip part 130 to allow rotations of the anti-slip part 130. However, when a foreign substance is fitted in the space, the rotations of the anti-slip part 130 are difficult. To address this issue, the upper body 131 of the anti-slip part 130 includes a left blade part 132L and a right blade part 132R. That is, referring to FIGS. 3 to 5, the left blade part 132L is a left edge extending in a left lower direction when being viewed in the width direction of the functional shoe, and the right blade part 132R is a right edge extending in a right lower direction when being viewed in the width direction of the functional shoe. Each of the left blade part 132L and the right blade part 132R is formed by two slopes 1321 and 1322 (refer to FIG. 3).

As such, when the upper body 131 includes a blade part 132, the blade part 132 may function as a blade of scissors to prevent the fitting of a foreign substance. The left blade part 132L and the right blade part 132R has a sharp edge that is defined by the two slopes 1321 and 1322 (refer to FIG. 3). Thus, referring to FIGS. 9 and 10, when the upper body 131 approaches the outsole 10 (or the installation part 300 when the installation part 300 is provided), the left blade part 132L and the right blade part 132R and portions of the outsole 10 (or portions of the installation part 300 when the installation part 300 is provided) corresponding to the left blade part 132L and the right blade part 132R may function as scissors to cut a foreign substance. The cut foreign substance may be moved down along the slopes 1321 and 1322 (refer to FIG. 3) of the upper body 131. As a result, when the upper body 131 includes the blade part 132, a foreign substance is prevented from being fitted in the space between the outsole 10 and the anti-slip part 130.

Referring to FIG. 5, a distance d is formed between a bottom surface of the outsole 10 and the ground G by the crampon parts 100. This may irritate a person wearing the functional shoe. However, since the outsole 10 may be formed of an elastic material, the crampon parts 100 may be relatively pushed upward by the weight of a person wearing the functional shoe. Thus, a distance as illustrated in FIG. 5 may not substantially irritate the person. To more reliably eliminate such irritation, a predetermined space may be formed above the crampon parts 100 in the outsole 10 (or the installation part 300 when the installation part 300 is provided).

INDUSTRIAL APPLICABILITY

According to the present invention, although a person wearing a functional shoe does not perform a separate process, the functional shoe automatically operates according to a slip of the functional shoe so as to prevent the slip. Thus, the functional shoe is industrially applicable.

What is claimed is:

1. A functional shoe that automatically prevents a slip, the functional shoe comprising:

a rotation body part fixed to an outsole of the functional shoe to rotate to a front or rear side of the functional shoe; and an anti-slip part connected to the rotation body part to contact a ground and rotating integrally with the rotation body part according to a sliding direction of the functional shoe, wherein the anti-slip part comprises a first distal end, which is sharp and is oriented to the front side of the functional shoe, a second distal end which is sharp and is oriented to the rear side of the functional shoe, and a horizontal surface which extends from the first distal end to the second distal end and overall contacts the ground;

wherein when the functional shoe starts to slide, the anti-slip part is rotated to the front or rear side of the functional shoe through the rotation body part by a resistance applied to the horizontal surface of the anti-slip part from the ground; and wherein the outsole and the horizontal surface are in contact with the ground prior to slipping.

2. The functional shoe of claim 1, wherein the first or second distal end is selectively stuck in the ground according to the rotation of the anti-slip part.

3. The functional shoe of claim 1, wherein the anti-slip part further comprises a first slope extending in a right upper direction from a left distal end of the horizontal surface when being viewed in a width direction of the functional shoe, and a second slope extending in a left upper direction from a right distal end of the horizontal surface when being viewed in the width direction of the functional shoe.

4. The functional shoe of claim 1, wherein the anti-slip part comprises a plurality of bottom protrusions that are sharp and extend to the ground.

5. The functional shoe of claim 4, wherein a part of the bottom protrusions are disposed at the left side of a vertical line extending from a rotation center of the rotation body part to the ground when being viewed in a width direction of the functional shoe, and the rest thereof are disposed at the right side of the vertical line.

6. The functional shoe of claim 1, wherein the anti-slip part comprises an upper body connected to the rotation body part, and a lower body connected to the upper body and provided with the first and second distal ends, the upper body comprises a left blade part as a left edge extending in a left lower direction when being viewed in a width direction of the functional shoe, and a right blade part as a right edge extending in a right lower direction when being viewed in the width direction of the functional shoe, and each of the left blade part and the right blade part is formed by two slopes.

7. The functional shoe of claim 1, further comprising an installation part sliding into an insertion recess which is formed on the outsole and extending in a width direction of the functional shoe, wherein the rotation body part is rotatably installed on the installation part and is provided on the outsole through the installation part.

8. The functional shoe of claim 1, wherein the rotation body part is provided in plurality in a width direction of the functional shoe, and the anti-slip part is provided in plurality to correspond to the rotation body parts.

9. The functional shoe of claim 1, wherein the rotation body part is elongated in a width direction of the functional shoe, and the anti-slip part is elongated in the width direction of the functional shoe to correspond to the rotation body part.

10. The functional shoe of claim 1, wherein the rotation body part is disposed on the heel of the functional shoe.

* * * * *